US008770529B2

(12) United States Patent
Berglund et al.

(10) Patent No.: US 8,770,529 B2
(45) Date of Patent: Jul. 8, 2014

(54) ADJUSTABLE ANGLE BRACKET

(75) Inventors: Terry Berglund, Hales Corners, WI (US); John Walrath, Pewaukee, WI (US)

(73) Assignee: Process Retail Group, Inc., New Berlin, WI (US)

( * ) Notice: Subject to any disclaimer, the term of this patent is extended or adjusted under 35 U.S.C. 154(b) by 0 days.

(21) Appl. No.: 13/429,912

(22) Filed: Mar. 26, 2012

(65) Prior Publication Data

US 2012/0241577 A1 Sep. 27, 2012

Related U.S. Application Data

(60) Provisional application No. 61/467,662, filed on Mar. 25, 2011.

(51) Int. Cl.

| | |
|---|---|
| ***A47G 29/02*** | (2006.01) |
| ***A47B 57/04*** | (2006.01) |
| ***A47B 96/07*** | (2006.01) |

(52) U.S. Cl.

CPC ..... *A47B 57/045* (2013.01); *A47B 96/07* (2013.01)

USPC ..... 248/242; 211/150

(58) Field of Classification Search

CPC ..... A47B 57/045; A47B 96/07

USPC ..... 248/242, 220.22, 243, 235, 240, 240.3; 211/90.01, 150, 187, 144, 134, 151

See application file for complete search history.

(56) References Cited

U.S. PATENT DOCUMENTS

| | | | | |
|---|---|---|---|---|
| 3,273,847 | A * | 9/1966 | Berman | 248/243 |
| 3,572,626 | A * | 3/1971 | Bertschi | 248/242 |
| 4,106,738 | A * | 8/1978 | Kostecky | 248/235 |
| 5,116,007 | A * | 5/1992 | Von Gunton et al. | 248/243 |
| 5,460,345 | A * | 10/1995 | Trevaskis | 248/225.21 |
| 5,975,318 | A * | 11/1999 | Jay | 211/90.01 |
| 8,231,092 | B2 * | 7/2012 | Shpitalni | 248/250 |

* cited by examiner

*Primary Examiner* — Todd M Epps

(74) *Attorney, Agent, or Firm* — Andrus Intellectual Property Law, LLP

(57) ABSTRACT

The adjustable angle bracket of the present application includes a plurality of tangs configured to engage a mounting device such that a top shelf support surface supports a shelving unit and provides a desired angle for the shelving unit. The device further includes a plurality of shelf coupling apertures compatible with various types of shelving units. The devices further include a cam that rests against the mounting device, providing variable positions of the device relative to the mounting bracket effectuating a variable angle of the shelf support surface.

20 Claims, 14 Drawing Sheets

ADJUSTABLE ANGLE BRACKET

CROSS REFERENCE TO RELATED APPLICATION

The present application claims priority to U.S. Provisional Application No. 61/467,662, filed Mar. 25, 2011, the content of which is incorporated herein by reference in its entirety.

FIELD OF THE INVENTION

The present application is directed to the field of shelf mounting. More specifically, the present application is directed to the field of hardware used for adjustable, angled shelf mounting.

BACKGROUND

Current brackets used for mounting shelves, and specifically shelving in retail and grocery store dairy cases and frozen food cases, do not typically include angle adjustability. Such brackets usually include two tangs that extend from the bracket and attach into apertures and a mounting device at the back of the cabinet. Such brackets provide for a fixed attachment point for shelving units. Such typically used brackets are limited in that they provide a fixed shelf angle, and they ordinarily utilize only two tangs to attach to the mounting device, thus having limited strength qualities for supporting shelves with heavier loads. Typical brackets further are only configured for compatibility with a single type of shelving system.

Furthermore, current brackets have no range of adjustability once they are installed in a mounting device. Typical brackets may be removed and reinserted into a mounting device to change or adjust the height of the shelf it is supporting, but cannot be adjusted once it is installed in order to change the angle of the shelf relative to horizontal. Typical brackets are therefore limited in providing a strong, efficient, compatible and adjustable angle shelf for such applications.

SUMMARY

The adjustable angle bracket of the present application includes a plurality of tangs configured to engage a mounting device such that a top shelf support surface supports a shelving unit and provides a desired angle for the shelving unit. The device further includes a plurality of shelf coupling apertures compatible with various types of shelving units. The devices further include a cam that rests against the mounting device, providing variable positions of the device relative to the mounting bracket effectuating a variable angle of the shelf support surface.

In one aspect of the present invention, an angle bracket comprises a body portion having a top surface configured to support a shelving unit, a first tang protruding from the body portion, the first tang having a first and second contact member, wherein the first and second contact member engage an aperture of a mounting device, a second tang protruding from the body portion, the second tang having a third contact member, wherein the third contact member engages the mounting device, wherein the first and second tangs secure the bracket to the mounting device, and a disk-shaped rotatable cam mounted to an end of the body portion opposite to the top surface, wherein a radius of the cam is variable relative to a mounting point of the cam, and further wherein an outer edge of the cam rests on the mounting device such that rotating the cam about its mounting point adjusts the angle of the top surface.

In another aspect of the present invention, an angle bracket comprises an adjustable angle top surface configured to support a shelving unit, a first tang protruding from the angle bracket, the first tang having a first and second contact member, wherein the first and second contact member engage an aperture of a mounting device, a second tang protruding from the angle bracket, the second tang having a third contact member, wherein the third contact member engages the mounting device, a third tang protruding from the angle bracket having a fourth contact member, wherein the second and third tang include an elongated contact surface, and a disk-shaped rotatable cam mounted to an end of the angle bracket opposite to the top surface, wherein a radius of the cam is variable relative to a mounting point of the cam, and further wherein an outer edge of the cam rests on the mounting device such that rotating the cam about its mounting point adjusts the angle of the top surface, and the elongated contact surfaces of the second and third tangs maintain contact with a bottom surface of the aperture of the mounting, device.

In another aspect of the present invention, an angle bracket comprises a body portion having a top surface configured to support a shelving unit, a first tang protruding from the body portion, the first tang having a first and second contact member, wherein the first and second contact member engage an aperture of a mounting device, a second tang protruding from the body portion, the second tang having a third contact member, wherein the third contact member engages the mounting device, wherein the first and second tangs secure the bracket to the mounting device, a third tang protruding from the body portion, the third tang having a fourth contact member, a disk-shaped rotatable cam mounted to an end of the body portion opposite to the top surface, wherein the outer edge of the cam includes a plurality of flat edges perpendicular to the radius of the cam relative to the mounting point, such that each flat edge defines a unique radius from the mounting point, and a plurality of shelf coupling apertures configured on the body portion of the bracket opposite the first, second and third tangs, such that the shelf coupling apertures accommodate a plurality of shelving systems, and wherein a radius of the cam is variable relative to a mounting point of the cam, and further wherein an outer edge of the cam rests on the mounting device such that rotating the cam about its mounting point adjusts the angle of the top surface, wherein the second and third tang include an elongated contact surface, wherein the elongated contact surface maintains contact with a bottom surface of the aperture of the mounting device such that rotation of the angle bracket about the first tang when the cam is rotated is effectuated.

DETAILED DESCRIPTION OF THE DRAWINGS

In the present description, certain terms have been used for brevity, clearness and understanding. No unnecessary limitations are to be applied therefrom beyond, the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

Figure 1A:
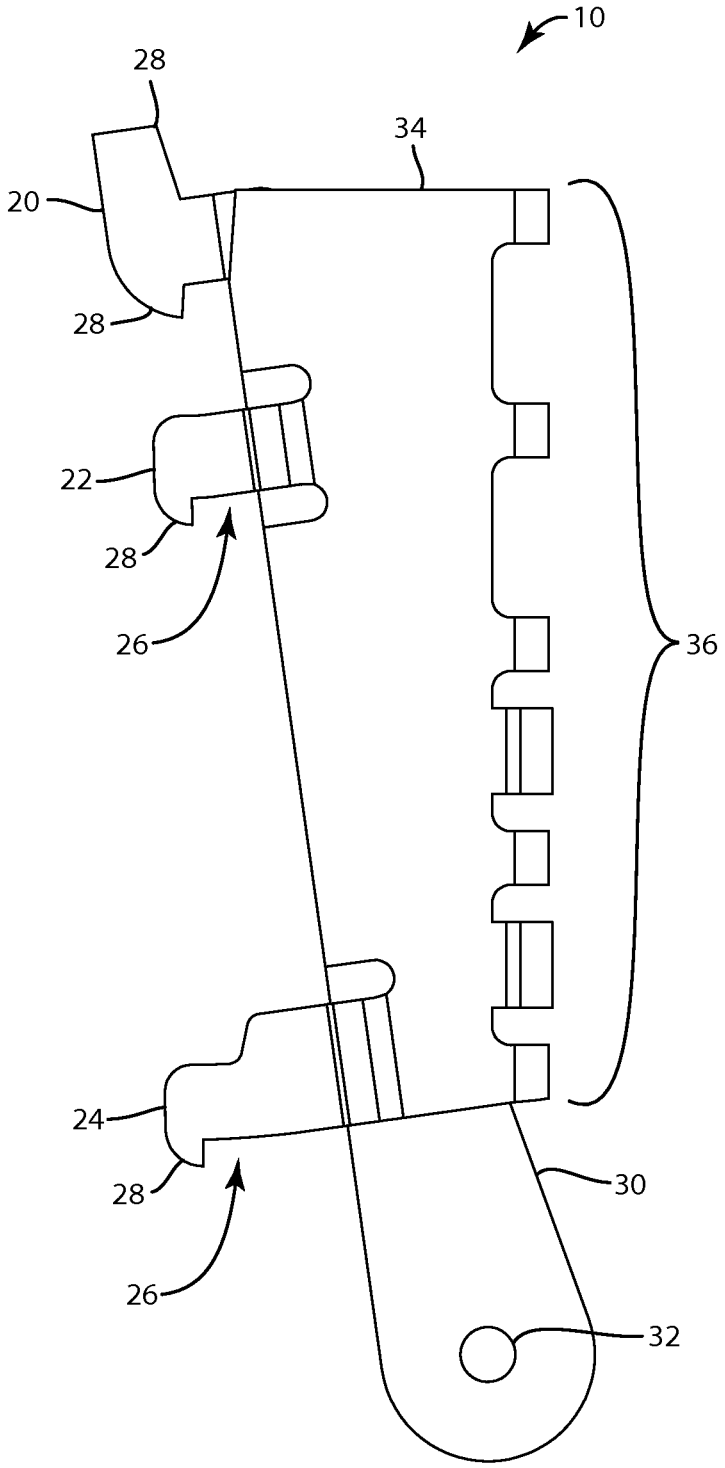
FIGS. 1*a*-1*f* illustrate a number of views of an embodiment of a bracket according to the present application.
Figure 1B:
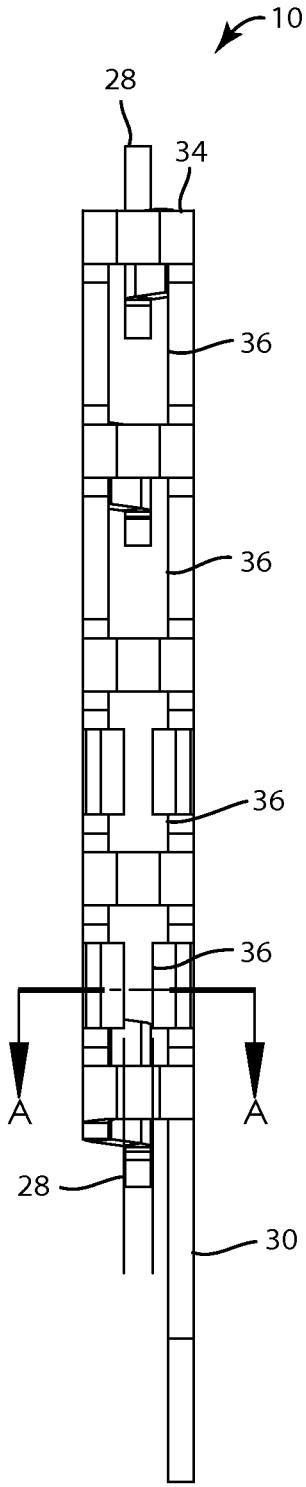
Figure 1C:
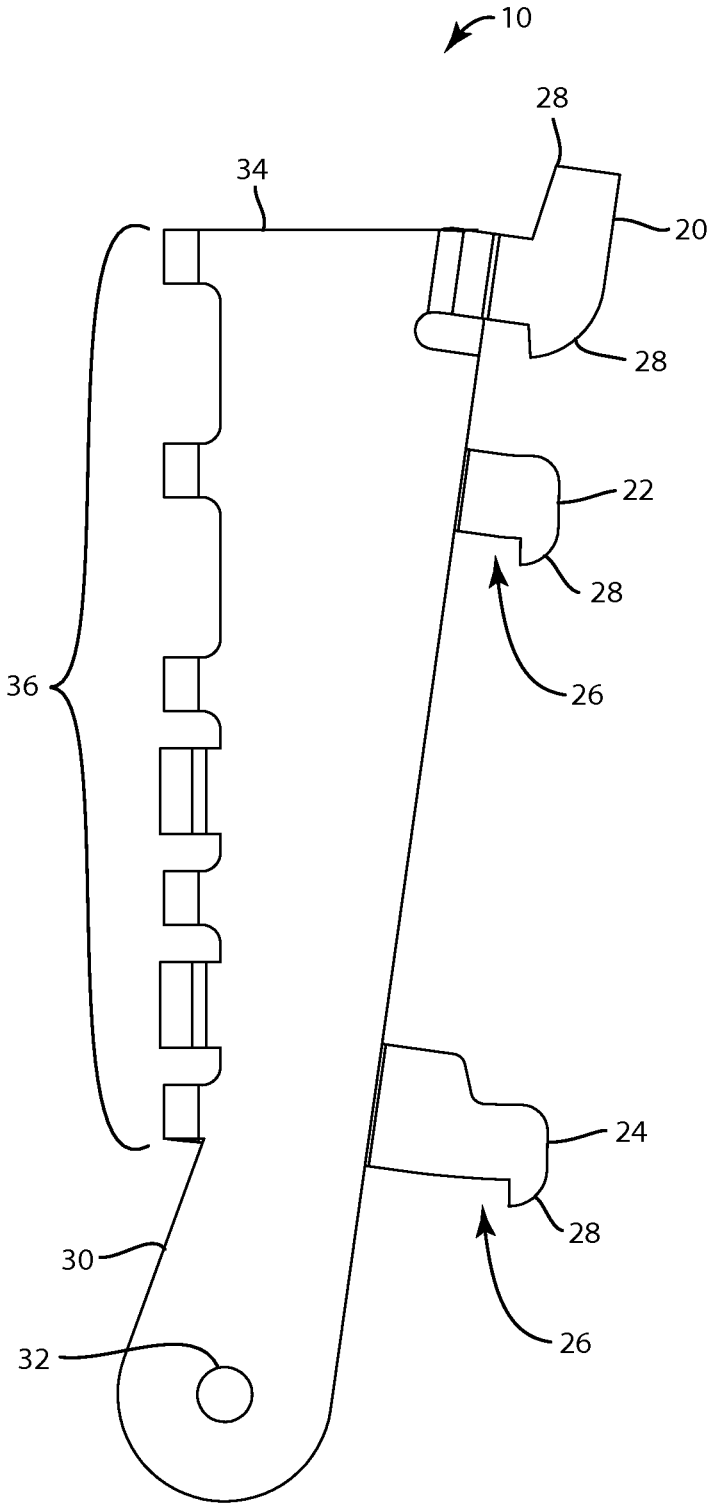
Figure 1D:
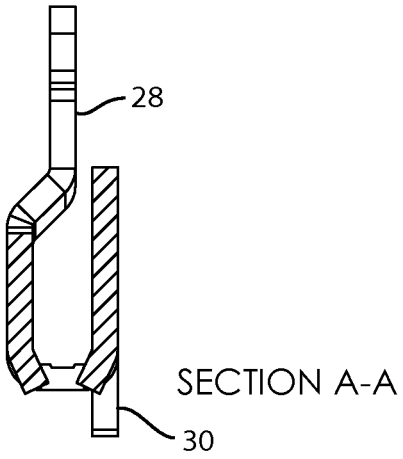
Figure 1E:
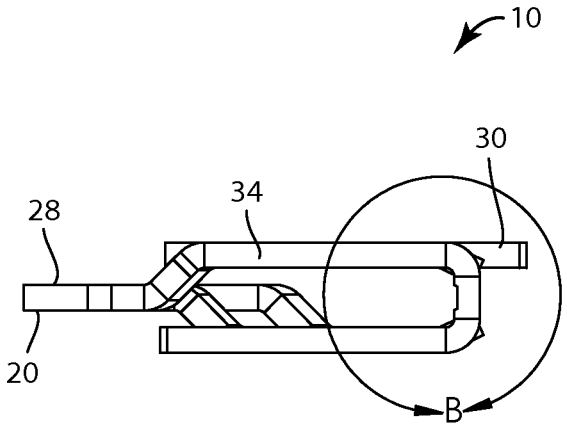

Referring to FIGS. 1*a* through 1*f* of the present application, the bracket 10 is shown in FIG. 1*a* in a side view, in FIG. 1*b* in a front view, FIG. 1*c* in an opposite side view, FIG. 1*d* in cross-section A-A from FIG. 1*b*, FIG. 1*e* in a bottom view, and in detail B from FIG. 1*e*. For ease of description, the Applicants have not included all of the reference numbers in every figure.

Referring to FIGS. 1*a*-1*c*, the bracket 10 includes of the illustrated embodiment a plurality of tangs 20, 22, 24, and each tang, 20, 22, 24, includes at least one contact member 28 and a contact surface 26. The contact member 28, as will be described further below, is inserted into a vertically positioned aperture on a mounting device 50 (FIG. 2*a*) or shelf wall, thus contacting the inside of the mounting device 50, and supporting the bracket and any shelf (not shown) being supported by the shelf support surface 34 of the bracket 10. A typical mounting device 50 will be explained in greater detail below. The tangs 20, 22, 24 also include a contact surface 26 that rests on a bottom surface of the aperture, also providing support for the bracket 10 and the accompanying shelf (not shown). The contact surface 26 of tangs 22, 24 in this illustrated embodiment are curved as to ensure that the contact surface 26 will remain in contact with a bottom surface of the aperture 52 throughout a range of adjustable angles that the bracket 10 is fashioned to maintain. The bracket 10 also includes a shelf support surface 34 and shelf coupling apertures 36, that in combination couple with and support a shelving unit (not shown). The shelf coupling apertures 36 are fashioned such that the bracket 10 is compatible with various shelving systems known in the art, and can be configured to adapt to future shelving systems as well. The bracket 10 further includes a cam arm 30 and a cam aperture 32 for supporting a cam 44, which will also be discussed in greater detail below.

Figure 1F:
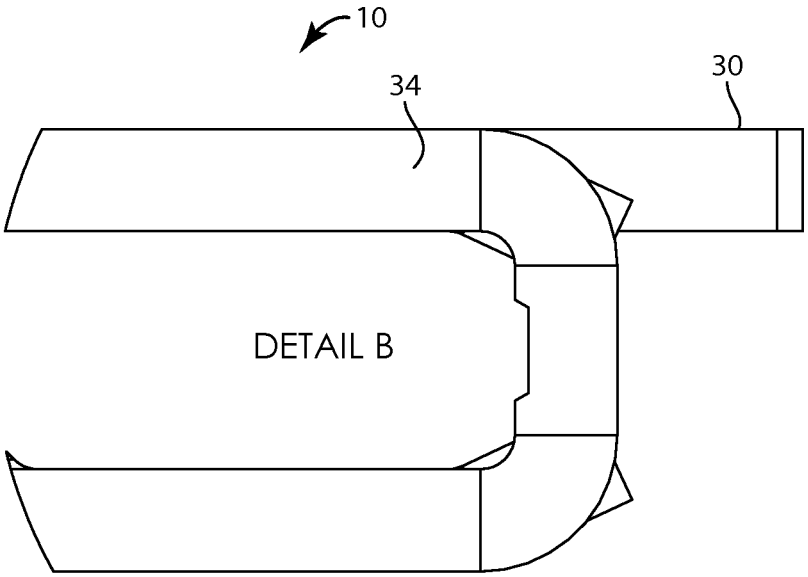

Referring to FIG. 1*d*, a cross-section A-A of FIG. 1*b* in top view of the device 10 is illustrated. Here, the tang 24 is illustrated extending from the device 10 in a first direction in order to engage with an aperture 52 of a mounting device 50 (not shown). FIG. 1*e* illustrates a similar top view of the entire device 10 including a tang 20 having a contact member 28 configured to also engage an aperture 52 of a mounting device (not shown). FIG. 1*e* also includes the cam arm 30 without the cam installed on the device 10. FIG. 1*f* includes a detail of B as indicated in FIG. 1*e*. In both FIGS. 1*e* and 1*f*, a shelf support surface 34 is shown on the top of the device 10. Still referring to FIGS. 1*d*-1*f*, it should be noted that in this illustrated embodiment, the device 10 may be fashioned from a single piece of steel or another piece of metal ordinarily utilized in such applications that may be cut into a single pattern piece, and arranged into the device 10 illustrated in FIGS. 1*a*-1*f*.

Referring now to FIGS. 2*a*-2*c* and 2*f*, the bracket 10 is shown installed on a mounting device 50 having a plurality of mounting, apertures 52. As was previously discussed above, the tang 20, 22, 24 of the bracket 10 are inserted into the mounting apertures 52, and the bracket 10 is supported by the contact members 28 engaging with an inside surface of the mounting surface 50. As can also be seen in FIGS. 2*b*-2*c*, the contact surfaces 26 of the bracket 10 support the bracket 10, and keep in contact with a bottom surface of the mounting apertures 52.

Figure 2A:
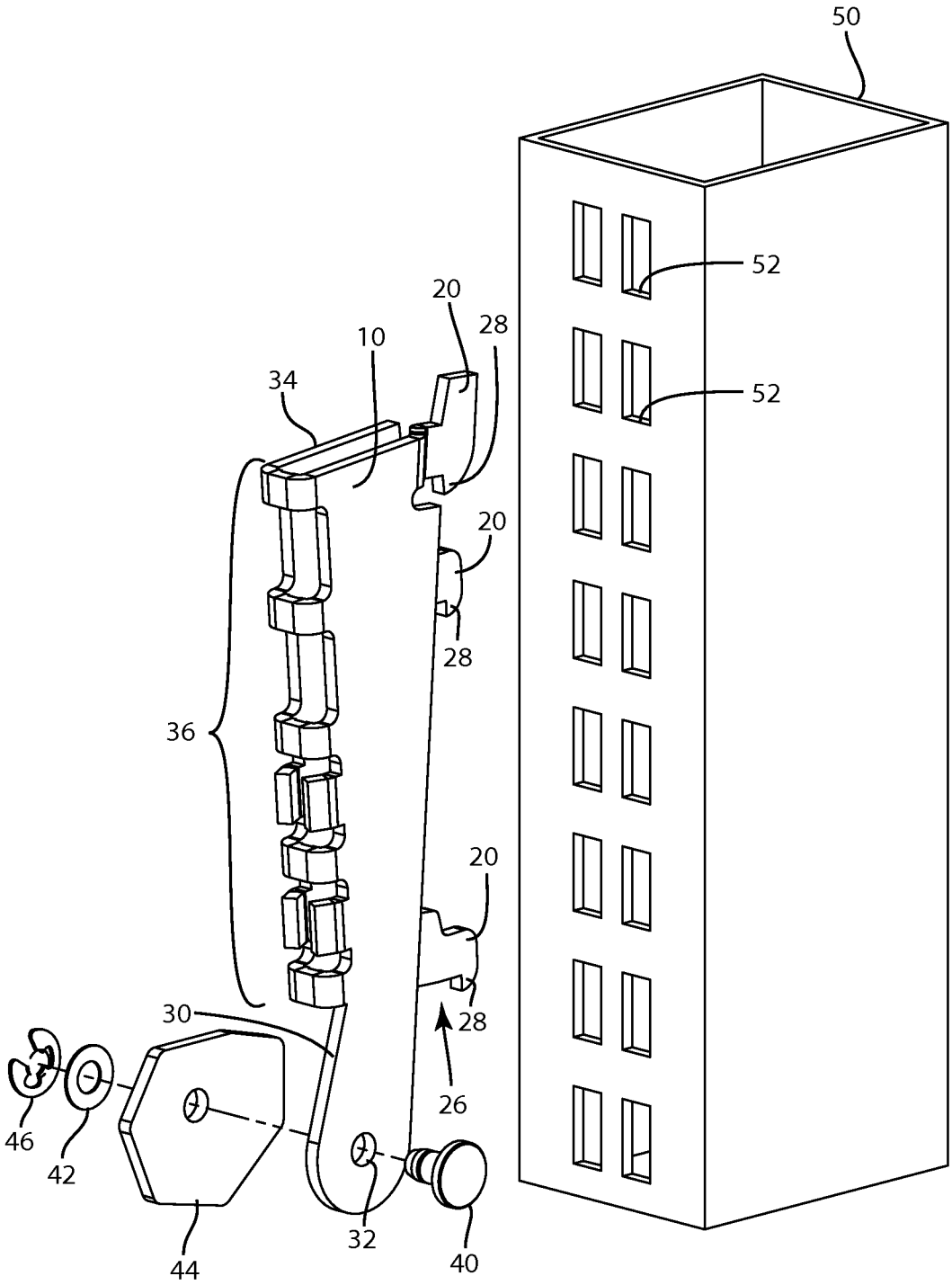
FIGS. 2*a*-2*g* illustrate a number of views of an embodiment of a bracket and a mounting device of the present application.
Figure 2B:
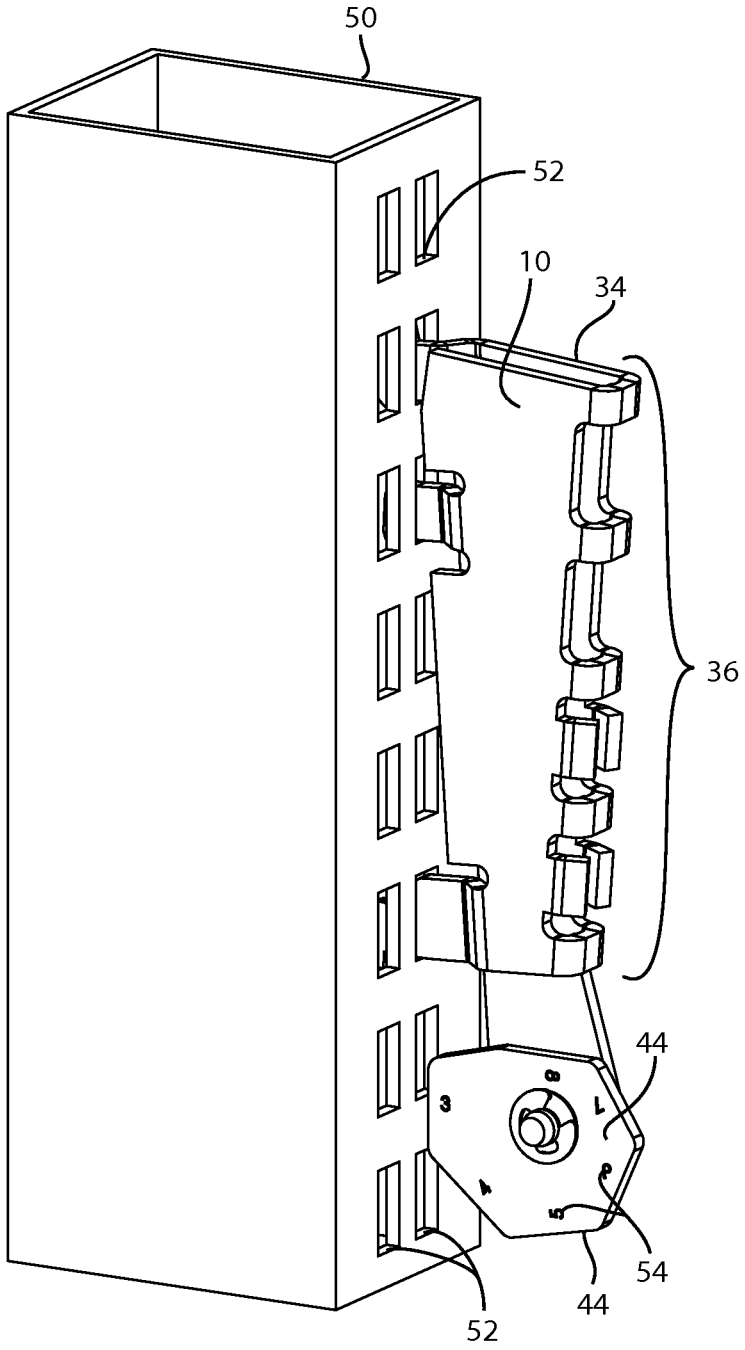
Figure 2C:
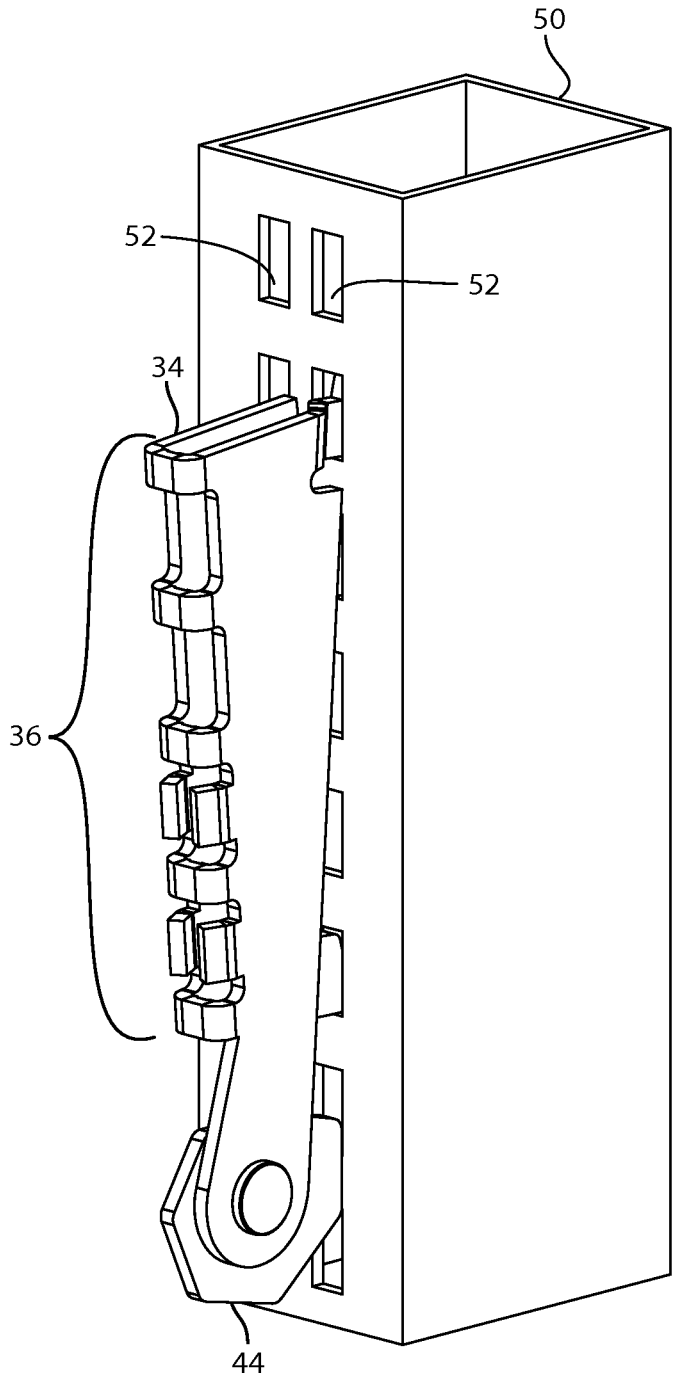
Figure 2D:
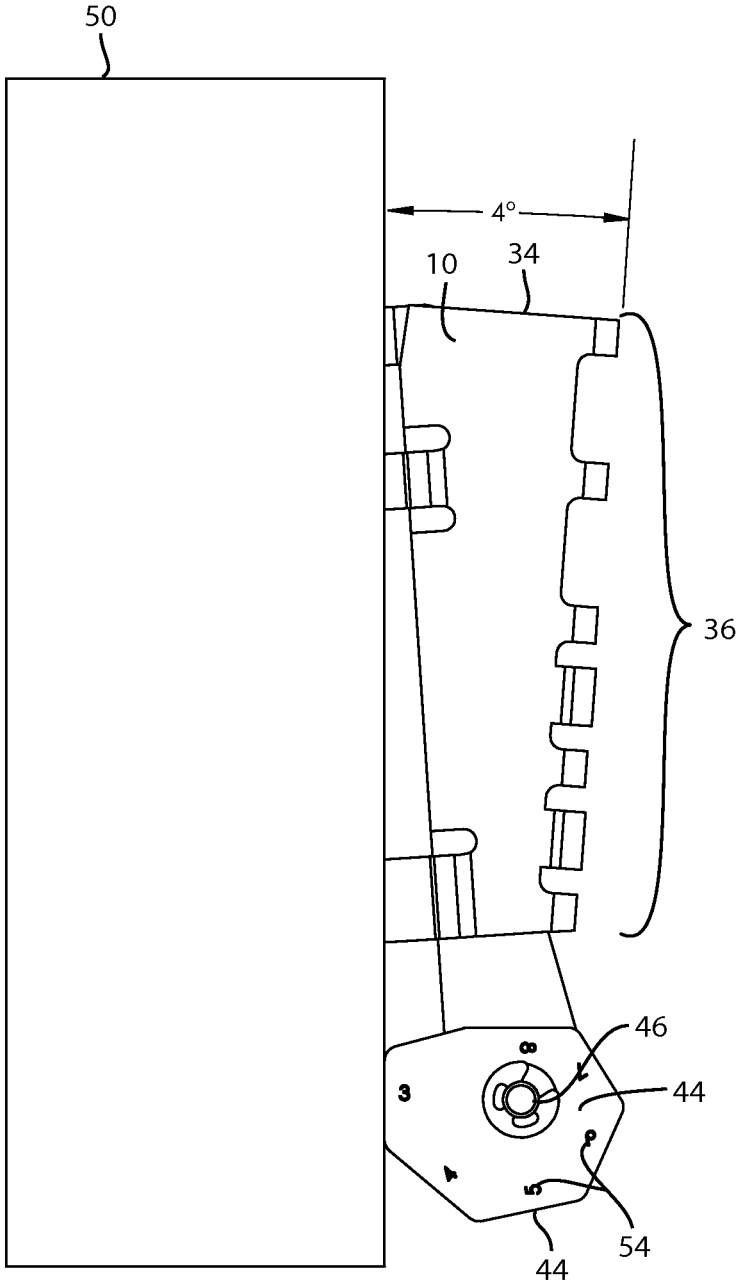
Figure 2E:
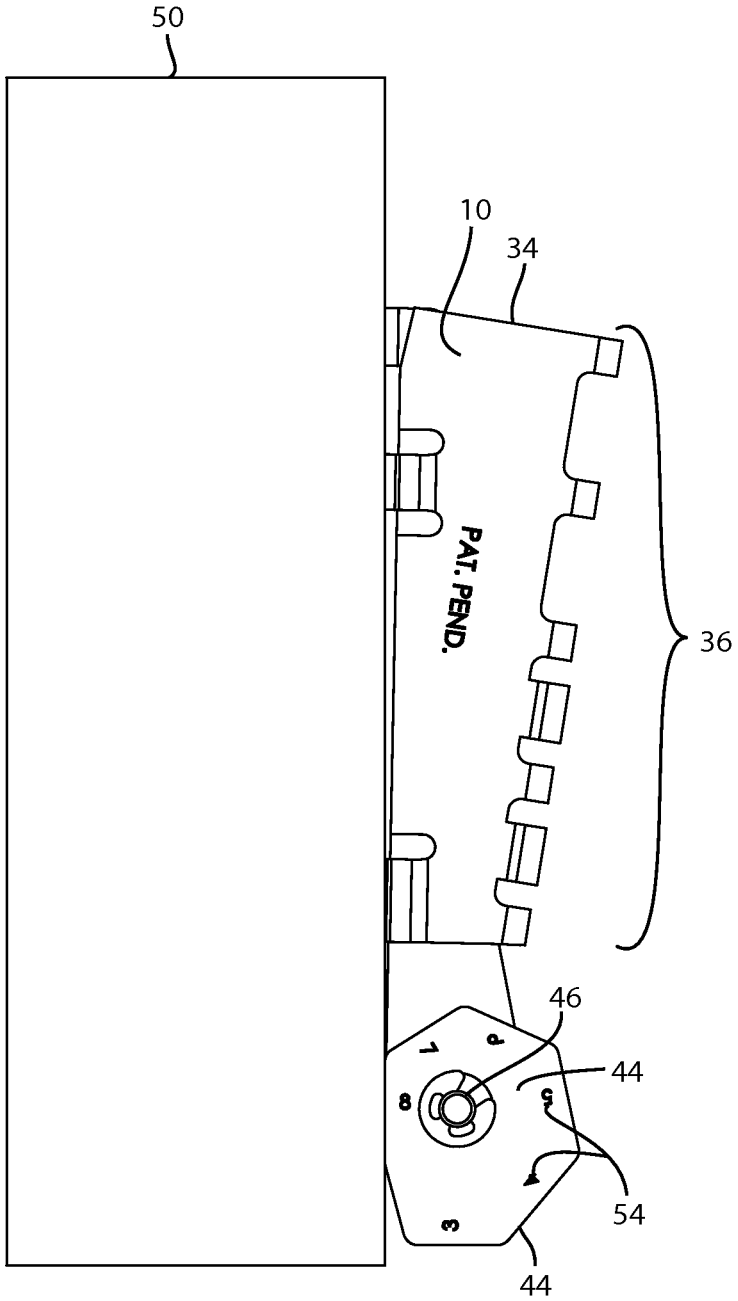
Figure 2F:
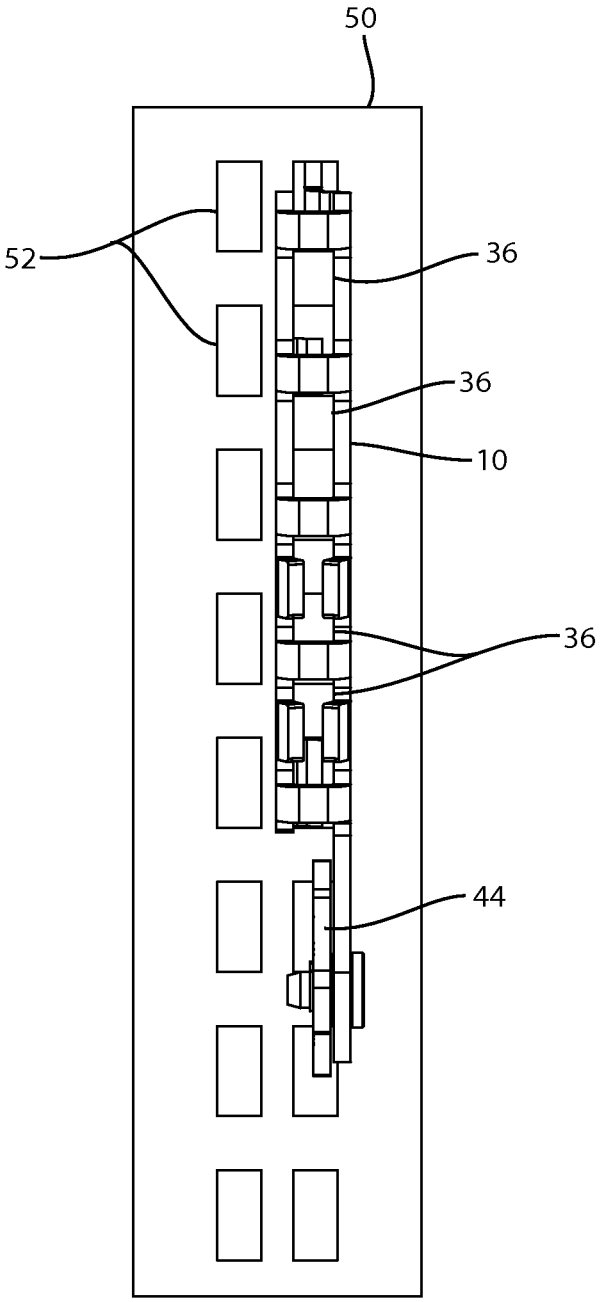
Figure 2G:
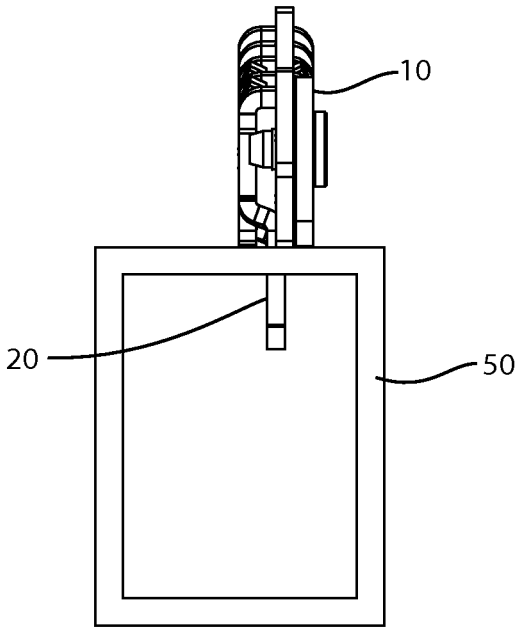

FIG. 2*g* illustrates a top view of the device 10 and the mounting device 50 illustrating how the device and in this case the tang 20 engage an inside surface of the mounting device in order to couple the device 10 to the mounting device 50.

Referring to FIG. 2*a*, a cam 44 is coupled with the cam arm 30 with attaching means. In this illustrated embodiment, the attaching means includes an assembly pin 40, a spring washer 42, and a snap ring 46. It should be noted that other attaching means may be used in other embodiments of the bracket 10, and are not limited to this configuration as illustrated. Furthermore, it is noted that the spring washer 42 provides an outward bias such that the cam 44 requires a clockwise or counterclockwise force to be applied to it in order to rotate. In other words, even if the cam 44 is not uniformly weighted, it will not rotate unless a user causes it to rotate by applying a rotational force. Again, in the illustrated embodiment, a spring washer 42 is utilized for this purpose. However, other embodiments may implement other biasing methods to achieve this result.

As further illustrated in FIGS. 2*b*-2*e*, once attached, the cam 44 includes a number of flat surfaces having varying distances from the cam aperture 32, such that when the bracket 10 is installed, the angle of the shelf support surface 34 is adjustable by turning the cam 44 in either a clockwise or counterclockwise direction and utilizing a flat surface of the cam 44 to support the bracket 10. The selected surface either has a shorter or longer distance from the cam aperture 32 than the previous surface.

Still referring to FIGS. 2*a*-2*e*, the illustrated embodiment of the cam 44 includes a six-surface cam 44 that is able to configure the shelf support surface 34 at an angle range of three degrees to eight degrees, depending on which flat surface is used to support the bracket 10 on the mounting device 50. Referring to FIG. 2*d*, when the angle indicator 54 in this embodiment is corresponding to the side of the cam 44 that is in contact with the mounting device 50, the number of the angle indicator 54 indicates the angle of the shelf support surface 34. This is illustrated in FIG. 2*d* as the angle indicator 54 number "3" is in contact with the mounting device and the angle of the shelf support surface is also 3°. It should be noted that the angle indicators 54 may include simply numbers as illustrated, or other indicators that may be used in the art, such as but not limited to, symbols for particular shelving units. It should be understood that further embodiments may include a cam 44 having more or less flat surfaces, thus allowing for more or less angle settings for the shelf support surface 34. Further embodiments also contemplate a cam 44 having various ranges of angles as well. It is also contemplated that the cam 44 may include a rounded surface having a graduated radius such that a continuous set of angles may be achieved. Such a contemplated cam 44 would also require a greater outwardly bias from the spring washer 42 or other biasing or locking devices for stability.

Figure 3A:
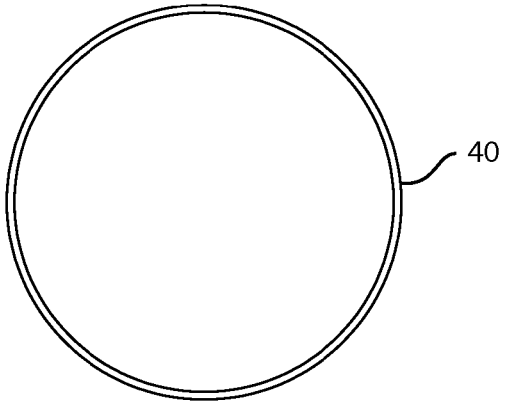
FIGS. 3*a*-3*d* illustrate a number of views of an embodiment of an assembly pin of the present application.
Figure 3B:
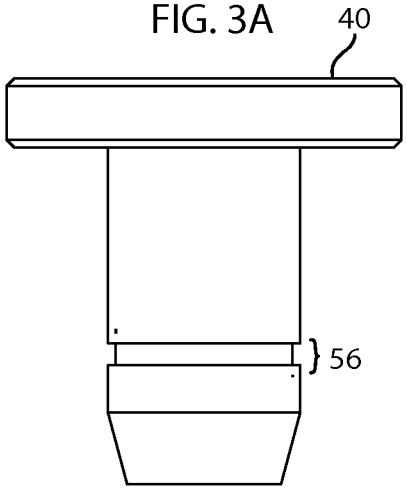
Figure 3C:
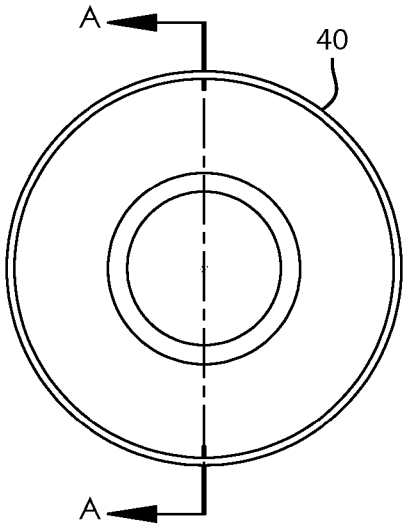
Figure 3D:
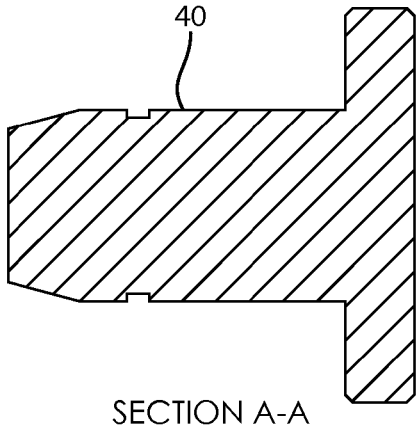

FIGS. 3*a*-3*d* include various views of the assembly pin 40 as shown in FIG. 2*a*. As stated above, it is contemplated that other attaching means may be utilized to fasten the cam 44 to the cam arm 30. Referring now to FIGS. 3*a*-3*d*, the assembly pin 40 includes a ridge 56 that accepts the snap ring 46 (FIG. 2*a*). FIG. 3*d* is a section A-A cross-section of the assembly pin 40 illustrated in FIG. 3*c*, illustrating that in this embodiment, the assembly pin is a single solid piece of preferably metal.

Referring again to FIGS. 2*a*-2*g*, the bracket 10 of the present application is utilized to adjust the angle of existing shelves in various product categories in a supermarket or other retail setting. The bracket 10 of the present application is configured to be universal, and specially configured to work with any known, existing, or future shelving system, i.e., frozen, refrigerated, gondola, etc. The bracket 10 of the present application creates the ability to place a shelf at an ideal angle to consistently feed product to the front of a shelf, but to feed such a product in a nonaggressive manner. When such product is currently stacked on the shelf, the bracket 10 of the present application allows that product to be merchandised in stacks for the sake of space management.

In comparison to existing fixed-angle gravity feed shelving, the bracket 10 of the present application and its adjustable angle configuration allows various product/package types to be gravity fed at a minimal angle, thus using vertical space more efficiently. The bracket 10 of the present application therefore assists and optimizes gravity-feed shelving systems that save significant amounts of labor by reducing the time required for stocking and shelf detailing, and allows for inventory reductions, as shelves look full at all times. This mitigates what is known in the trade as "shopkeeper mentality" or the need to present a fully stocked shelf to the customer at all times, regardless of inventory turns. The use of this bracket 10 to improve gravity-feed shelving also optimizes product presentation at all times and has thus repeatedly provided sales increases as a result.

Utilizing two or three tangs 20, 22, 24, or more tangs, also increases the weight load capability over typical shelving brackets, and increases the field life of such brackets 10.

The bracket 10 of the present application, in the embodiment illustrated, is constructed of a high-strength steel, or may be fashioned out of any material that allows for a bracket that can withstand the weight and longevity requirements of the shelving system.

In operation, the shelf support surface 34 can be adjusted by rotating the cam 44 on the cam arm 30 before installing the bracket 10 in the mounting device 50, or while the bracket 10 is installed in the mounting device 50. In another embodiment, the angle of the shelf support surface 34 can be adjusted by rotating the cam 44 without a spring washer 42, or other biasing device. Tensioning the cam 44 in such a way allows the cam 44 to turn easily, but to hold a position until a shelf is mounted on the shelf support surface 34 and shelf coupling apertures 36.

This written description uses examples to disclose the invention, including the best mode, and also to enable any person skilled in the art to make anew the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An angle bracket, comprising:

a body portion having a top surface on a first end of the body portion configured to support a shelving unit;

a first tang protruding from the body portion, the first tang having a first contact member and a second contact member, wherein the first and second contact members engage a first aperture of a mounting device;

a second tang protruding from the body portion, the second tang having a third contact member, wherein the third contact member engages a second aperture of the mounting device, wherein the first and second tangs secure the bracket to the mounting device; and a disk-shaped rotatable cam mounted to a second end of the body portion opposite to the first end, wherein a radius of the cam is variable relative to a mounting point of the cam, and further wherein an outer edge of the cam rests on the mounting device such that rotating, the cam about the mounting point adjusts an angle of the top surface, wherein the second tang includes a first recessed elongated contact surface, wherein the first recessed elongated contact surface maintains contact with a bottom surface of the second aperture of the mounting device such the rotation of the angle bracket about the first tang when the cam is rotated is effectuated.

2. The angle bracket of claim 1, further including a third tang protruding from the body portion, the third tang having a fourth contact member, wherein the third tang is located proximate to the end of the body portion where the rotatable cam is mounted.

3. The angle bracket of claim 2, wherein the third tang includes a second recessed elongated contact surface that maintains contact with the bottom surface of a third aperture of the mounting device.

4. The angle bracket of claim 1, wherein the outer edge of the cam includes as plurality of flat edges, wherein the flat edges are each perpendicular to a shortest path from each respective flat edge to the mounting point, and such that the perpendicular distance from the mounting point to each of the plurality of flat edges is unique.

5. The angle bracket of claim 1, wherein the cam includes a single, continuous outside edge.

6. The angle bracket of claim 1, wherein the cam is fastened to a cam arm with an attaching means.

7. The angle bracket of claim 6, wherein the cam arm extends from the body portion of the bracket.

8. The angle bracket of claim 6, wherein the attaching means includes an assembly pin, a spring washer, and a snap ring, and the attaching means attaches the cam to the cam arm through a cam aperture.

9. The angle bracket of claim 2, further comprising a plurality of shelf coupling apertures configured on the body portion of the bracket opposite the first, second and third tangs, such that the shelf coupling apertures accommodate a plurality of shelving systems.

10. The angle bracket of claim 1, wherein the mounting device includes a plurality of apertures.

11. The angle bracket of claim 1, further including a plurality of angle indicators positioned on the cam that communicate to a user corresponding angles of the lop surface of the body portion.

12. An angle bracket, comprising:

an adjustable angle top surface of a first end of the angle bracket configured to support a shelving unit;

a first tang protruding from the angle bracket, the first tang having a first contact member and a second contact member, wherein the first and second contact members engage a first aperture of a mounting, device;

a second tang protruding from the angle bracket, the second tang having a third contact member, wherein the third contact member engages a second aperture of the mounting device;

a third tang protruding from the angle bracket having a fourth contact member, wherein the second and third tangs include first and second recessed elongated contact surfaces; and a disk-shaped rotatable cam mounted to a second end of the angle bracket opposite the first end, wherein a radius of the cam is variable relative to a mounting point of the cam, and further wherein an outer edge of the cam rests on the mounting device such that rotating the cam about its mounting point adjusts an angle of the top surface, and the first and second recessed elongated contact surfaces of the second and third tangs maintain contact with a bottom surface of the second aperture and a third aperture of the mounting device.

13. The angle bracket of claim 12, wherein the outer edge of the cam includes a plurality of flat edges, wherein each of the flat edges are perpendicular to a shortest path from each respective flat edge to the mounting point, and such that the perpendicular distance from the mounting point to each of the plurality of flat edges is unique.

14. The angle bracket of claim 12, wherein the cam includes a single, continuous outside edge.

15. The angle bracket of claim 12, wherein the cam is fastened to a cam arm with an attaching means.

16. The angle bracket of claim 15, wherein the cam arm extends from the body portion of the bracket.

17. The angle bracket of claim 15, wherein the attaching, means includes an assembly pin, a spring washer, and a snap ring, and the attaching means attaches the cam to the cam arm through a cam aperture.

18. The angle bracket of claim 12, further comprising a plurality of shelf coupling apertures configured on the body portion of the bracket opposite the first, second and third tangs, such that the shelf coupling apertures accommodate a plurality of shelving systems.

19. The angle bracket of claim 12, further including a plurality of angle indicators positioned on the cam that communicate to a user corresponding angles of the top surface of the body portion.

20. An angle bracket, comprising:

a body portion having a top surface in a first end of the body portion configured to support a shelving unit;

a first tang protruding from the body portion, the first tang having as first contact member and a second contact member, wherein the first and second contact members engage a first aperture of a mounting device;

a second tang protruding from the body portion, the second tang having a third contact member, wherein the third contact member engages a second aperture of the mounting device, wherein the first and second tangs secure the bracket to the mounting device;

a third tang protruding from the body portion, the third tang having a fourth contact member, a disk-shaped rotatable cam mounted to a second end of the body portion opposite to the first end, wherein the outer edge of the cam includes a plurality of flat edges, wherein each of the flat edges are perpendicular to the shortest path from each respective flat edge to the mounting point, and such that the perpendicular distance from the mounting point to each of the plurality of flat edges is unique; and a plurality of shelf coupling apertures configured on the body portion of the bracket opposite the first, second and third tangs, such that the shelf coupling apertures accommodate a plurality of shelving systems; and wherein a radius of the cam is variable relative to a mounting point of the cam, and further wherein an outer edge of the cam rests on the mounting device such that rotating the cam about its mounting point adjusts an angle of the top surface, wherein the second and third tangs include first and second recessed elongated contact surfaces, wherein the first and second recessed elongated contact surfaces contact with a bottom surface of the second aperture and a third aperture of the mounting device such that rotation of the angle bracket about the first tang when the cam is rotated is effectuated.

* * * * *